US007559666B2

(12) United States Patent
Liu

(10) Patent No.: US 7,559,666 B2
(45) Date of Patent: Jul. 14, 2009

(54) ILLUMINANT IMITATION PLANT AND METHOD OF MAKING THE SAME

(76) Inventor: Li Min Liu, Fenlin Lue Zhou F05-31A, Da Tuen Road, Chaoyang District, Beijing (CN)

( * ) Notice: Subject to any disclaimer, the term of this patent is extended or adjusted under 35 U.S.C. 154(b) by 449 days.

(21) Appl. No.: 11/030,749

(22) Filed: Nov. 16, 2004

(65) Prior Publication Data

US 2005/0136197 A1 Jun. 23, 2005

(30) Foreign Application Priority Data

Nov. 17, 2003 (CN) ..... 2003 1 0105107

(51) Int. Cl.
*F21S 6/00* (2006.01)

(52) U.S. Cl. ..... 362/123; 362/249.18; 362/564; 362/805

(58) Field of Classification Search ..... 362/122, 362/123, 249, 252, 563, 564, 567, 805, 806, 362/249.06, 249.07, 249.08, 249.14, 249.16, 362/249.18, 249.19; 428/18, 21, 24, 26
See application file for complete search history.

(56) References Cited

U.S. PATENT DOCUMENTS 4,789,572 A * 12/1988 Weaver ..... 362/122
7,108,391 B2 * 9/2006 Chuang ..... 362/122
2002/0141203 A1 * 10/2002 Shieh et al. ..... 362/123
2005/0042395 A1 * 2/2005 Kentner et al. ..... 428/24
2006/0008598 A1 * 1/2006 Pitman ..... 428/21

FOREIGN PATENT DOCUMENTS

CN 00107380.X 5/2000
CN 00132173.0 12/2000

* cited by examiner

*Primary Examiner*—Y My Quach Lee
(74) *Attorney, Agent, or Firm*—Merchant & Gould P.C.

(57) ABSTRACT

An illuminating imitation plant, comprising a stem, twigs and leaves. Said stem is made as the pattern of a real plant stem and stem light circles and light bands are arranged outside or inside the stem at intervals; the elastic supporting rod is installed in the middle of said stem and interposes pin said stem; meanwhile, the illuminant bodies are installed inside twigs on which multiple leaves are distributed; said leaves imitate the natural leaves and colors and show natural flexible patterns and are also inserted with elastic strips and with distributed light bands made of illuminant bodies and photo conducting materials. The twigs and leaves are ideally elastic and flexible especially can wobble vividly when it is breezy. They also glow more evenly and dimly and the effects of night illuming and decorating are excellent.

10 Claims, 13 Drawing Sheets

A-A rotating

ILLUMINANT IMITATION PLANT AND METHOD OF MAKING THE SAME

TECHNICAL FIELD

The present invention relates to a kind of decoration lamps, particularly to a kind of plant-like decoration lamps as designed to imitate the patterns of a plant.

BACKGROUND ART

There are currently variety of decoration lamp products, such as, the color lamp series, the electronic decoration lamps, etc., as well as some coconut tree lamps of imitation plants, bamboo leaves and the like. These imitation plant lamps abstractly exhibiting the patterns of the plants are fixed still somewhere and all of leaves and stems are solid and hard. They embody an abstract shape and artistic fashion of an integrated structure, and they beautify and brighten the scenery of a city and have been applied for the Chinese patents, e.g., the patent "The Color Lamps Imitating the Coconut Tree" with the application No. 00107380X and the patent "The Color Lamps Imitating the Bamboo" with the application No. 00132173.0, etc. Also there are some un-illuminant imitation plants which look like real plants at the aspects of the color and the shape, especially viewing them during daytime. They, however, are not visible at night and therefore lose the decoration effects. The tree lamps produced in conventional ways are generally of hard stems and leaves and short of elasticity and flexibility, and also they cannot change their shapes naturally. Therefore, they do not assort with the natural twigs surrounded especially in windy days and reveal more flaws. Although there already exist tree-like lamps, most of them are made conventionally and are arranged in a string and hung up on twigs and leaves. Moreover, the lamps glow more intensely and blindingly, but the places far from them are darker, which is more like a luminance of spot light source and is not even and which cannot bring about an ideal effect of the luminance and the decoration. This shortage is more evident when a closer observation is made.

CONTENTS OF THE INVENTION

The primary technical problem to be solved in the invention is to provide a kind of illuminant imitation plant, wherein the twigs and leaves possess ideal elasticity and flexibility, especially they can freely wobble when it is breezy and look more natural and verisimilar. Moreover, the illuminant imitation plant may emit even and dim light and the night illuming and decorating are more significant.

Another technical problem to be solved is to provide a method for making a kind of illuminant imitation plant, which is easy to be implemented and costs low.

The technical solutions adopted for solving the above mentioned primary technical problems are: a kind of illuminant imitation plant which comprises connected stems, twigs and leaves. It characterizes in that said stems are made as the shape and color of the real ones; said twigs are centrally located with elastic supporting rods and are connected with stems by interposing, also there are multiple leaves distributed on stems; said leaves imitate natural leaves and colors and thus show a soft pattern, and also the elastic strings are installed on the leaves and distributed with light bands consisting of illuminant bodies and photo conducting materials.

To be perfected is that the stem light circles or light bands are distributed at intervals outside or inside said stem and the light bands consisting of illuminant bodies and photo conducting materials are installed inside twigs, so that the effects of illumination and decoration are improved.

The significant improvement is that the elastic supporting rods installed inside said twigs are made of elastic steel wires or elastic supporting rods comprising multiple elastic steel wires, or elastic framework ribs or tendons made by injection molding; the elastic strings passing through said leaves are made of elastic steel wires. Such structure is simple and easy to be manufactured and also costs low.

It is beneficial that said light bands are made of illuminant bodies and segmented photo conducting materials, which are connected in series at intervals and pass through the hollow cavities inside leaves or are stuck to the leaves. In addition, said light bands may also be made of illuminant bodies and segmented photo conducting materials, i.e., one illuminant body links to a length of photo conducting material segment. EL cold light wires may also be adopt to be installed in the hollow cavities which are distributed inside both the leaves and the twigs or stuck to the leaves or twigs. These structures are simple and easy to be implemented for production and make twigs and leaves glow more evenly and softly. Moreover, the effects of illumination and decoration are more evident at night.

It is more beneficial that said twigs and leaves are hollow in structure and are shaped by plastic injection molding or extrusion molding, wherein the central part is located with the elastic framework tendons, the two sides are platy leaf blades; inside the framework tendons, the hollow cavities are distributed and positioned in the same direction as tendons; the cavities are divide into respective cavities for loading steel wires and light bands. The unique hollow cavity structure ensures that the plastic injection molding is easier to be made to produce imitation twigs and leaves and also that elastic twigs and laminate strips are conveniently inserted. The hollow cavity structure may be of a single supporting hole and a single illuminant body placing hole or double supporting holes and double illuminant body placing holes, etc.

What can be further improved is that said stem tops are sealed and connected with a power supply block terminal; the power supply block terminal is connected with a cable linker through a cable water proof lock which can prevent stems and the power supply control and the cable inside from getting wet by rain water so as to obtain a securer system. Meanwhile, it is also useful for connecting the power supplier in the stem to the electric wires distributed in the twigs and leaves and locking the cable for waterproof and preventing from pulling off.

Furthermore, cables inside said twigs are inserted into the plastic soft tubes and the openings of the plastic soft tubes are airtight sealed by processes of thermal sealing, glue adhesion or pressure injection, which makes it possible that the cable wires can smoothly slide in the hollow cavities and prevent efficiently the cable wires from pulling off in the gale.

Finally, said illuminant bodies use LED tube or EL cold light laminae or wires or OLED illuminant bodies for the purposes of saving energy, environmental protection and longevity of the use.

Another technical solution for solving the other technical problem is a kind of method for making illuminant imitation plant with the steps in order: to pre-prepare a whole imitation stem or the separated stems and then to assemble them to be an entire one; to prepare imitation plant leaves by using flexible photopermeable materials after the injection molding or extrusion process, and the hollow cavities comprising supporting holes and lamp placing holes to be prepared at the same time and then to prune the made leaves as desired shapes, then to put the light bands comprising elastic strips, illuminant bodies and photo conducting materials into leaves, wherein the cable wire connecting every illuminant bodies on the leaves are encompassed with plastic soft tubes, further, to add elastic supporting rods to assemble said multiple leaves to a twig by using injection molding or pouring; then to insert the twigs with leaves to the imitating stems, and make the power supply control supply electrical current to illuminant bodies through connecting cable and cable linker with respective cables on each twig and the adjust control program may make illuminant plants be twinkling or lighting constantly and the illuminant imitation plants are thus made.

Another technical solution for solving the other technical problem of the present invention is to prepare a whole imitation stem or separated imitation stems and then to assemble them as an entirety, also to install the stem light circles or light bands outside the stems at the intervals;

Imitation leaves are made by using color plastics or fabric materials, and illuminant bodies and photo conducting materials are filled in the hollow cavities preserved in the leaves. Further, the illuminant bodies and photo conducting materials are arranged at intervals and then sealed as strip-like light bands, or it may be possible that illuminant bodies and photo conducting materials construct light bands which are then stuck to leaves or connect to leaves by injection molding. The elastic strips pass through leaves which connect with twigs, meanwhile, the cables of illuminant bodies inside the leaves also link with those inside the twigs. A twig is constructed by one leave and one leave stalk or multiple leaves with one leave stalk, and is passed through by elastic supporting rods. Also a twig is installed with light bands comprising illuminant bodies and photo conducting materials;

The twigs bearing leaves are then inserted into imitating stems and the power supply control at the lower middle part of the imitating stem supply electrical current to the lamp series by the cables connecting with those of twigs, leaves and imitating stems so as to produce an illuminant imitation plant.

In view of the prior art, the advantages of the present invention are as follows:

1). It is highly practical because it is viewed as a real tree during daytime and a decoration lamp of imitating a real tree at night, which has solved the problem that the imitation plants are dark in the evening;

2). The whole imitation plant is natural of appearance at the aspects of the color and shape and is different from those abstract color imitation plant lamps made previously. Especially it can wobble when it is breezy and views more real. Moreover, the light bands glow more evenly and hazier and be away of the glaring light and therefore can be mounted in the halls or the gates as a view of either real plants or the color imitation plant lamps.

3). The manufacturing processes are simple and easy to be implemented. It uses elastic supporting rods which make twigs and leaves wobble in the wind and the colors be natural and costs low, especially using the hollow cavity structure for the twigs and leaves with which the twigs and leaves of the imitating plant can be easily achieved by plastic molding and processing and meanwhile by which the elastic twigs and illuminant strips are easily to be inserted and thus to get a more natural effect for an imitating plant.

MODE OF CARRYING OUT THE INVENTION

The following is a detailed description for the present invention together with the accompanying drawings.

EXAMPLE 1

Figure 1:
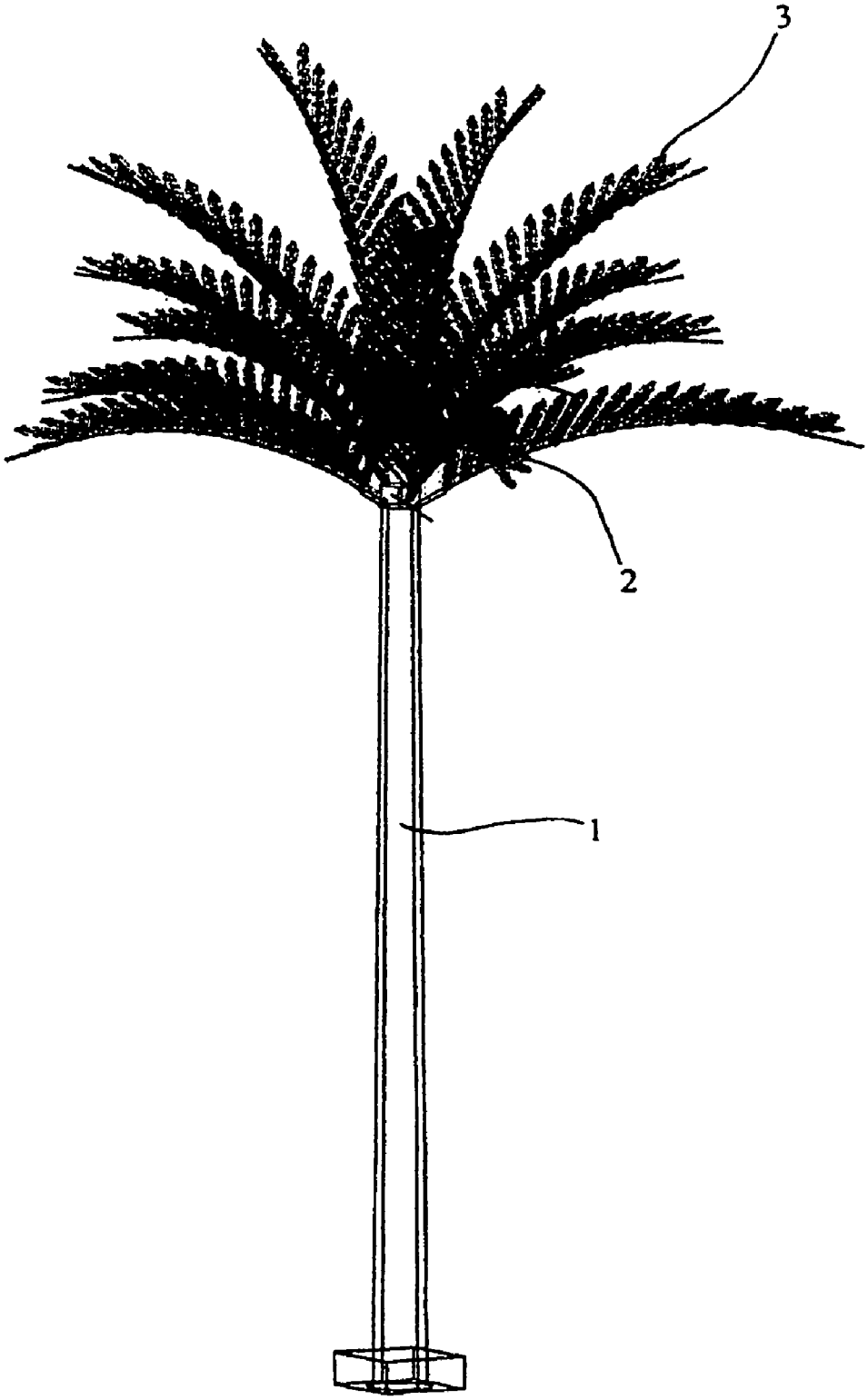
FIG. 1 is a stereo effect drawing of an illuminant imitation plant.
Figure 9:
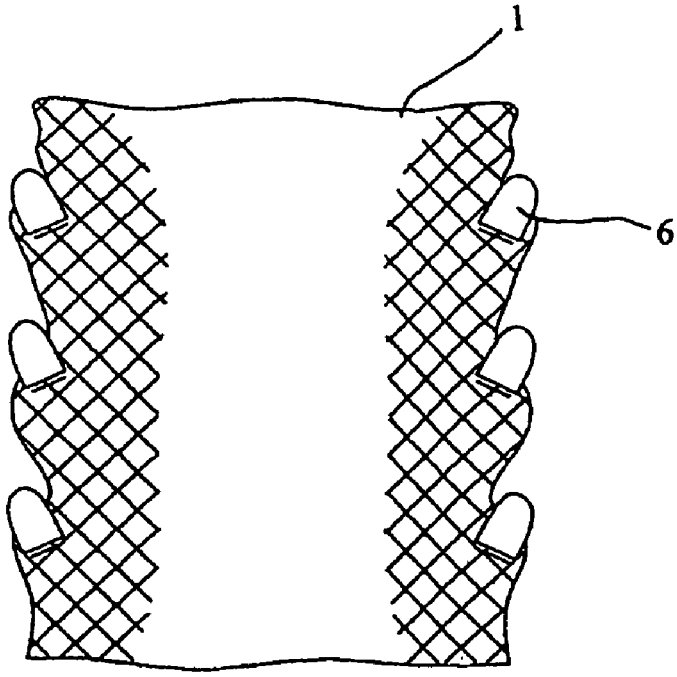
FIG. 9 is a schematic drawing of a stem of the present invention.
Figure 10:
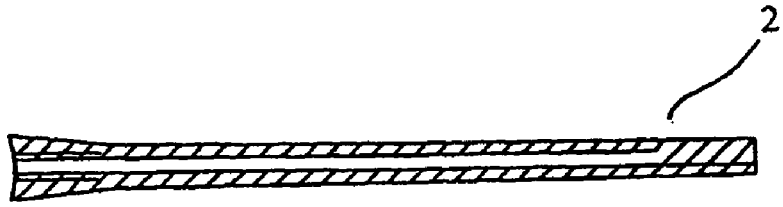
FIG. 10 is a schematic drawing of a twig.
Figure 11:
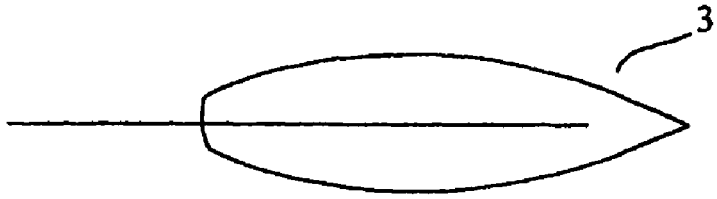
FIG. 11 is a schematic drawing of a leaf.
Figure 12:
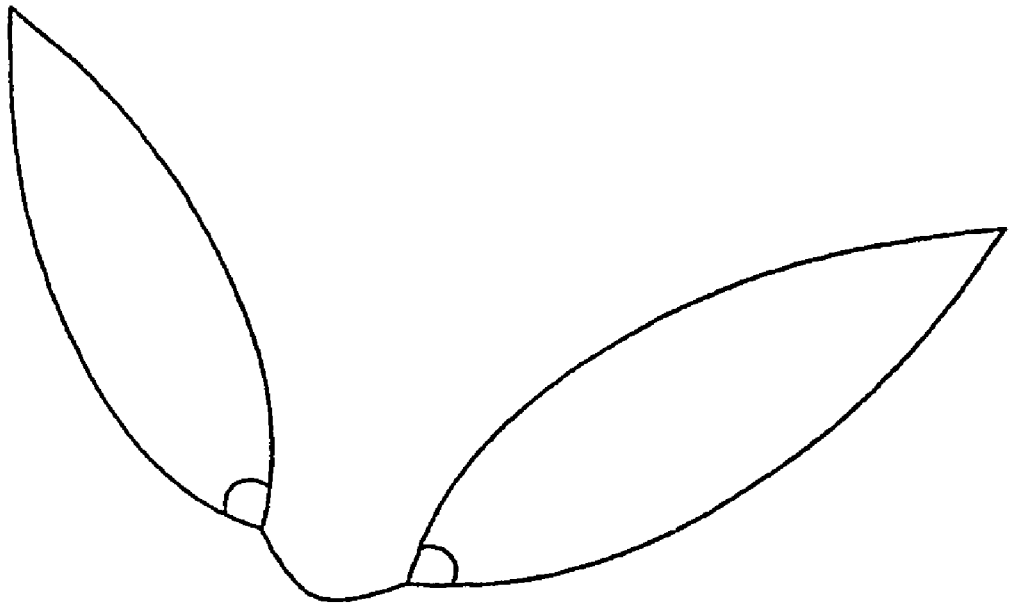
FIG. 12 is a schematic drawing of a joint leaf.
Figure 13:
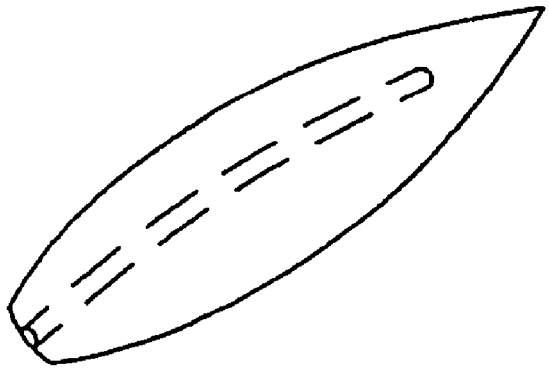
FIG. 13 shows the structure of a single spot illuminant leaf.
Figure 14:
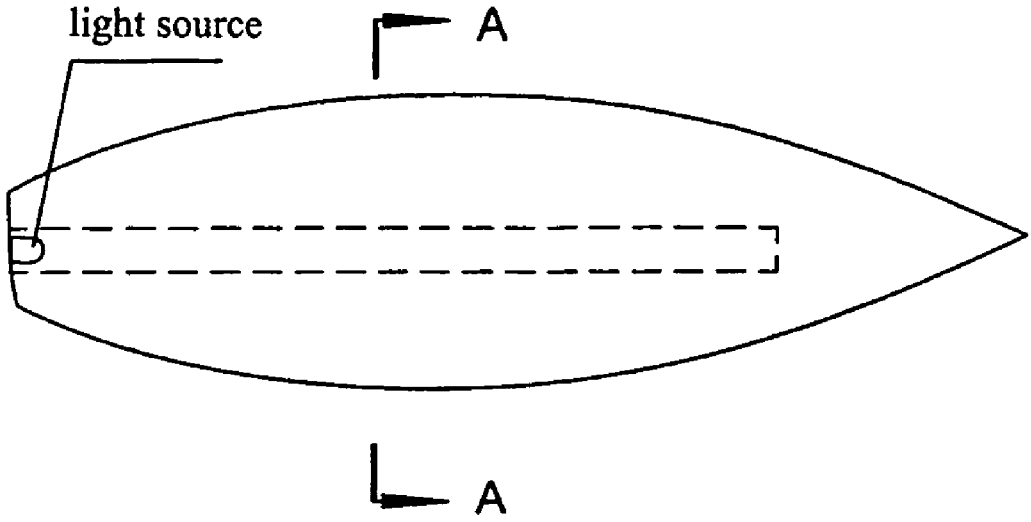
FIG. 14 is a schematic drawing of an entire light band of the outer sticking type of the present invention.
Figure 14:
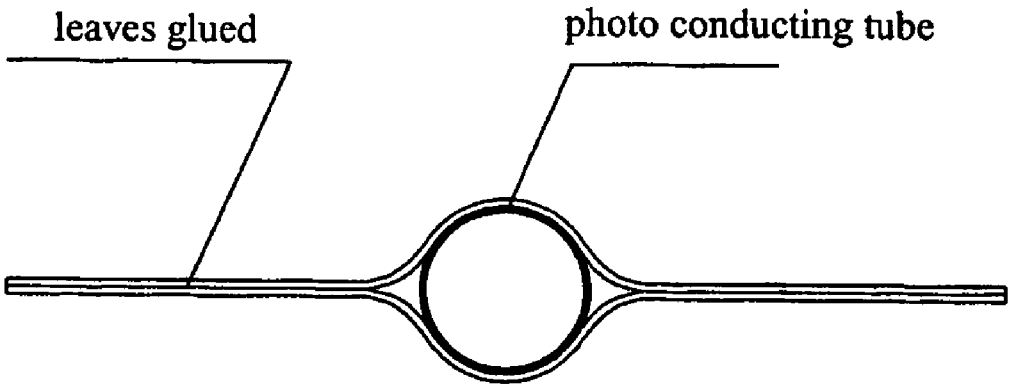

As shown in FIGS. 1-6, the imitation plant can be made as variety of shapes and moldings, such as the coconut tree, banyan, bamboo, maple and palm tree, etc. FIG. 1 is a molding of a coconut tree. Stem 1 of the large scale plant may be made of the cement or poured by the resin and the metal framework, or poured by the plastic and the metal framework, also it can be made either a whole stem or segmented stems and then to be assembled into entire stem 1 on the spot. The smaller scale plant can be made of the resin or the plastic materials and the outer layer of stem 1 may be molded as a real tree with natural color and also be arranged with multiple stem light circles on it. These light circles may be connected in series as light bands or light circles by illuminant body 6 such as LED tubes or EL clod light laminae or wires. Said light bands or light circles are then glued to or winded by pouring around the outer surface of the stem and be fixed inside it to produce stem light circles arranging at intervals. Or it can be made of mini lamps connecting in series which are set into the outer layer of stem 1 or glued to the outer surface of the stem so as to form light circles or light bands arranging at intervals, as shown in FIG. 9.

Figure 5A:
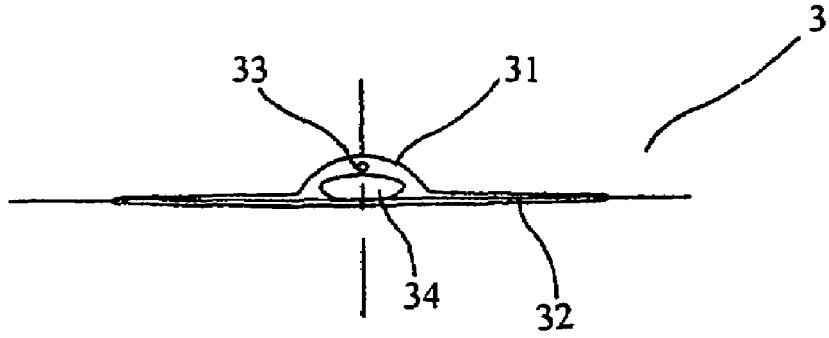
FIG. 5*a* is a cross-section of single supporting hole and a single placing illuminant body hole of a leaf.
Figure 5B:
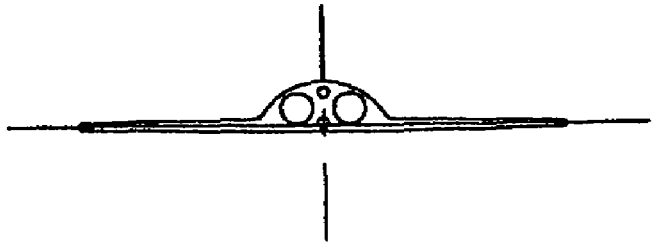
FIG. 5*b* is a cross-section of double supporting holes and double placing illuminant body holes of a leaf.
Figure 5C:
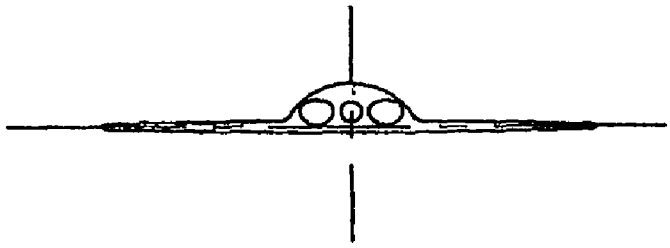
FIG. 5*c* is a cross-section of a single supporting hole and double placing illuminant body holes of a leaf.
Figure 6:
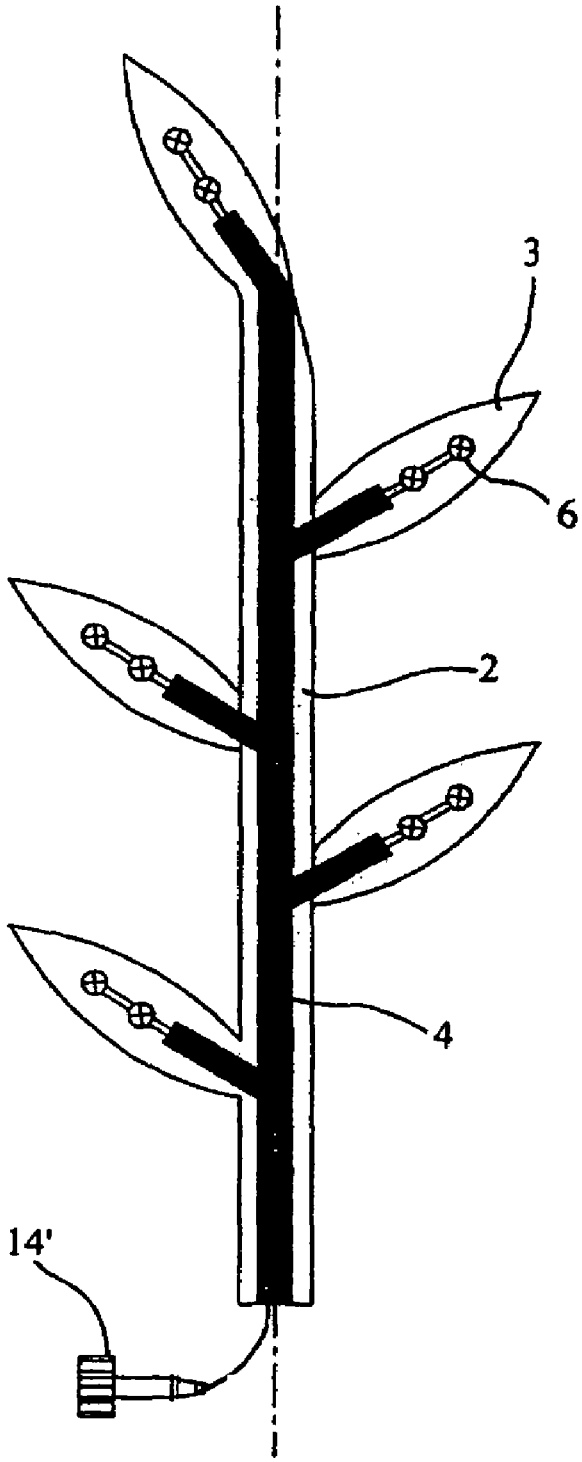
FIG. 6 shows the structure of a twig.
Figure 15:
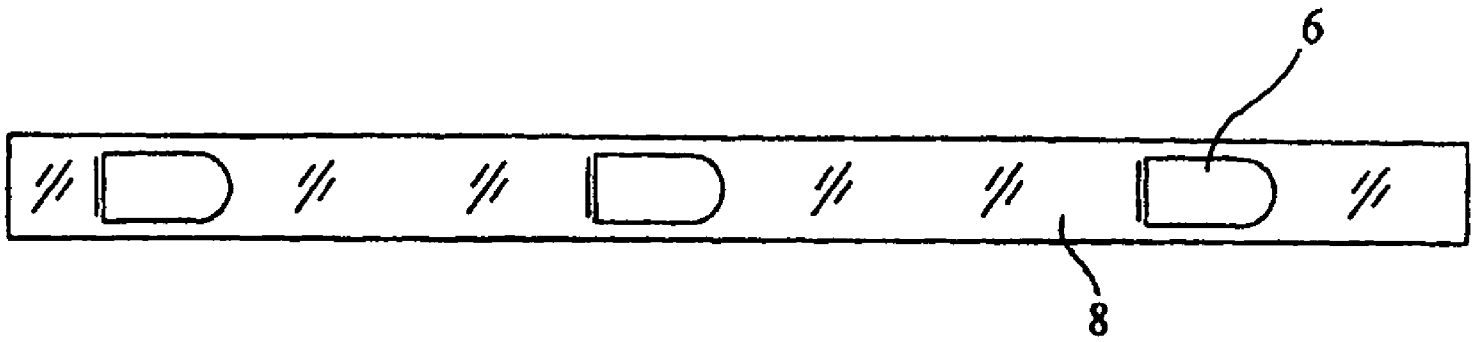
FIG. 15 is a schematic drawing of a light band of an illuminant body sealed in a photo conducting material of the present invention.
Figure 16:
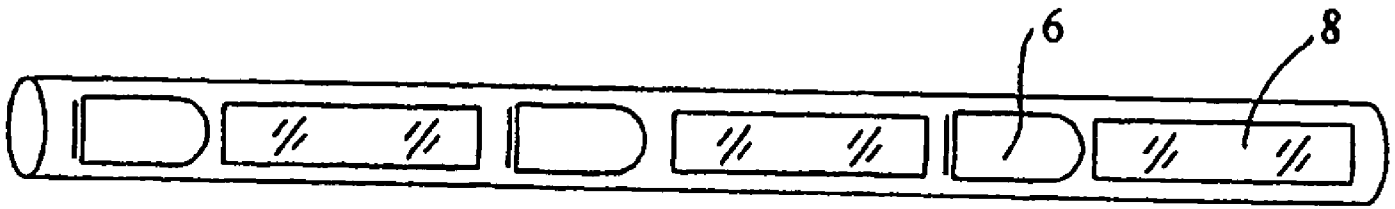
FIG. 16 shows a light band comprising multiple illuminant bodies and segmented photo conducting materials connected with each other in series.
Figure 17A:
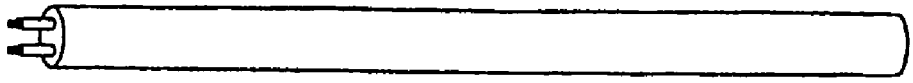
FIG. 17*a* is a laminated illuminant strip constructed directly by EL cold light wires or OLED illuminant body of the present invention.
Figure 17B:
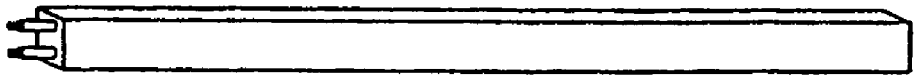
FIG. 17*b* is a laminated illuminant strip constructed directly by EL cold light wires or OLED illuminant body of the present invention.
Figure 18:
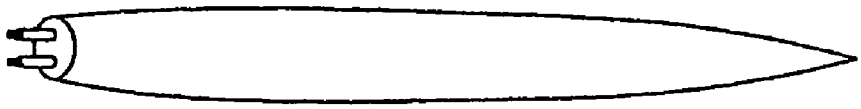
FIG. 18 is a leaf-like illuminant body constructed directly by EL cold light wires or OLED illuminant body of the present invention.
Figure 19:
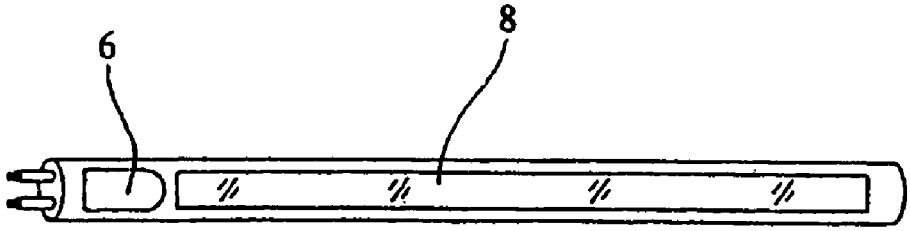
FIG. 19 is a light band made of an illuminant body and a segment of photo conducting material of the present invention.
Figure 20:
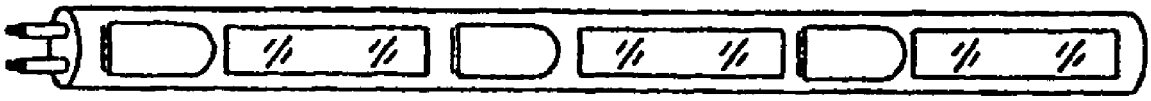
FIG. 20 shows a light band constructed by an illuminant body and photo conducting material arranged at intervals of the present invention.

Leaves 3 of the present invention are made of colored flexible photopermeable materials, e.g., PVC. The photopermeable materials are made as leaves of the imitated real plant by pouring or extrusion and the two sides of the resulting leave 32 are platy and the middle of it is the elastic framework tendon 31 in which the hollow cavities are distributed in the same direction and they are respectively for locating the elastic strip such as the steel strip and the light band. The pattern of the hollow cavities is selectively and can be cavities of a single supporting hole and a single placing illuminant body hole as well, as shown in FIG. 5*a*; the middle hole with smaller diameter is supporting hole 33, and the two side holes with bigger diameters are illuminant body 34; it may also be the cavity of double supporting holes and double placing illuminant body holes, as shown in FIG. 5*b*, the two smaller holes of upper and lower in the middle of the leaf are supporting holes, while the two side holes with bigger diameters are illuminant body holes; or it is the cavity of the single supporting hole and the double placing illuminant body holes, as shown in FIG. 5*c*, the smaller hole in the middle is a supporting hole and the two side bigger holes are illuminant body holes. And then it needs to prune the resulting leaves and make them as desired patterns and insert the elastic strip such as the steel wires into the supporting hollow cavities, in the meantime, to put illuminant body 6 such as LED tubes or mini lamps into the hollow cavities of the placing illuminant body holes. A preferable design for the structure is to insert the light bands or light strips into the hollow cavities inside the placing illuminant holes and the light bands or light strips are made of photo conducting material 8 and illuminant body 6, refer to FIGS. 14, 15, 16, 7 and 8 for details. Photo conducting material 8 consists of transparent materials of easily photo conducting, such as PVC or EVA, and other materials with good quality of photo conducting are also optional. One structure is designed as segmented photo conducting cylinders of photo conducting material 8, in which illuminant body 6 and the photo conducting cylinders are connected with each other in series to form a continuous light band or light strip and then are sealed with glue and put into the hollow cavities of the illuminant body holes of the leaves, refer to FIG 16. Another structure is designed to seal illuminant body 6 into the photo conducting 8 to form a light band, refer to FIG. 15, which can also be manufactured as strips, laminae or leaf-like by using EL cold light wires or OLED illuminant body laminae to form continuous light bands or light strips and then are sealed into the hollow cavities of the illuminant body holes in the leaves, refer to FIGS. 17 and 18. Further, it can be an illuminant body opposite to a length of photo conducting material to form a light band or a light strip and then be sealed into the hollow cavities of the illuminant body holes in the leaves, refer to FIG. 19. Depending on the requirements, the structure patterns may be various and optional. Cable 5 is inserted into plastic soft tube 4 and links to the illuminant bodies in each group of leaves, refer to FIGS. 3 and 4, and the openings of the plastic soft tubes and the cable wires are airtight sealed by the processes of thermal melting, glue adhesion or pressure injection. The aim of the airtight sealing is to keep a space in the plastic soft tube after the entirely pouring or pressure injection and ensures that the cable wires can smoothly slide in the hollow cavities and prevent efficiently the cable wires from pulling off in the gale. Finally, an entire twig is completed after the multiple leaves and the plastic soft tubes being assembled by pressure injection or pouring, refer to FIG. 6. It is necessary to pre-prepare multiple twigs according to the methods mentioned above.

Figure 2:
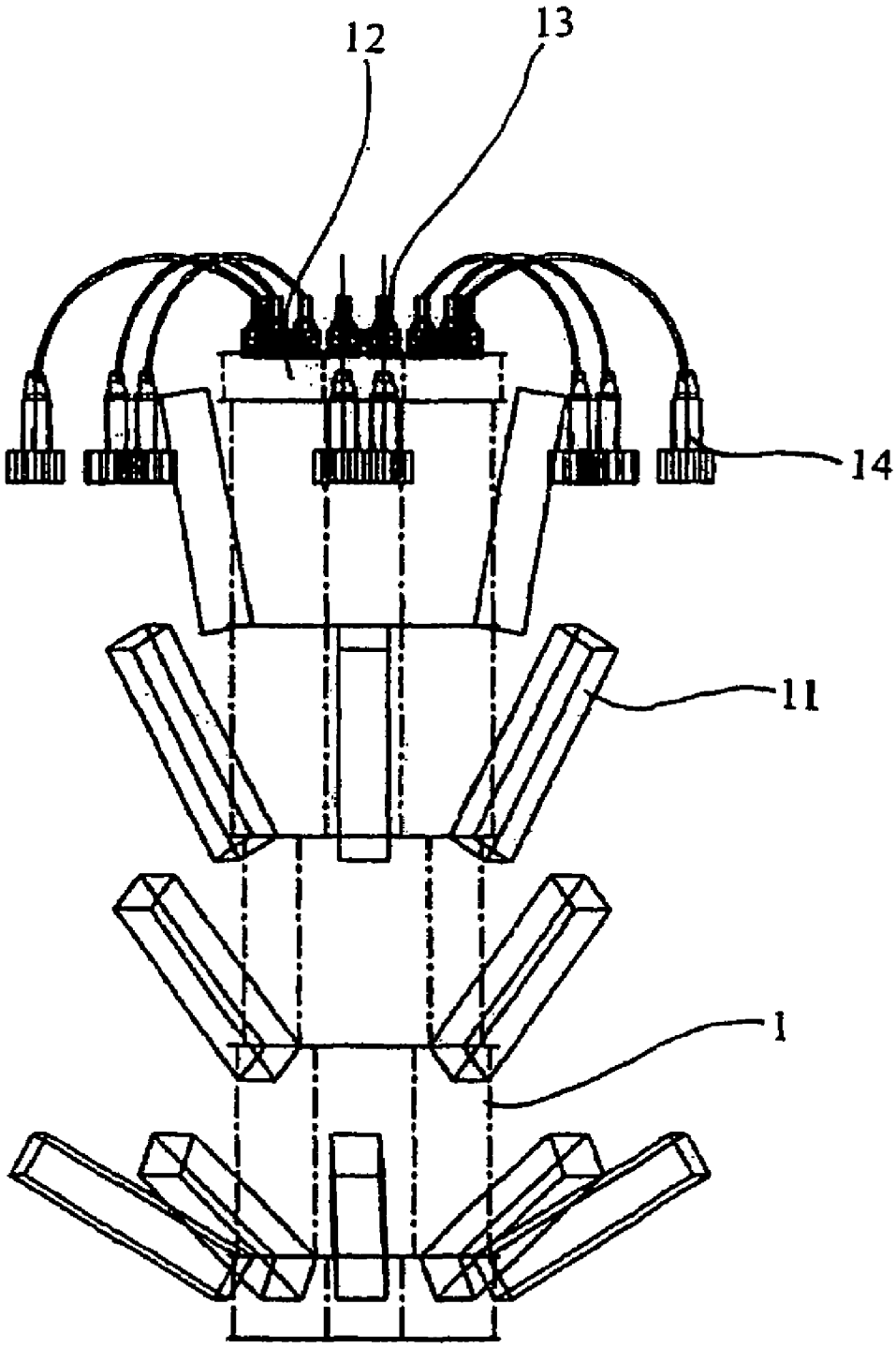
FIG. 2 is a schematic drawing of the top of a plant.
Figure 3:
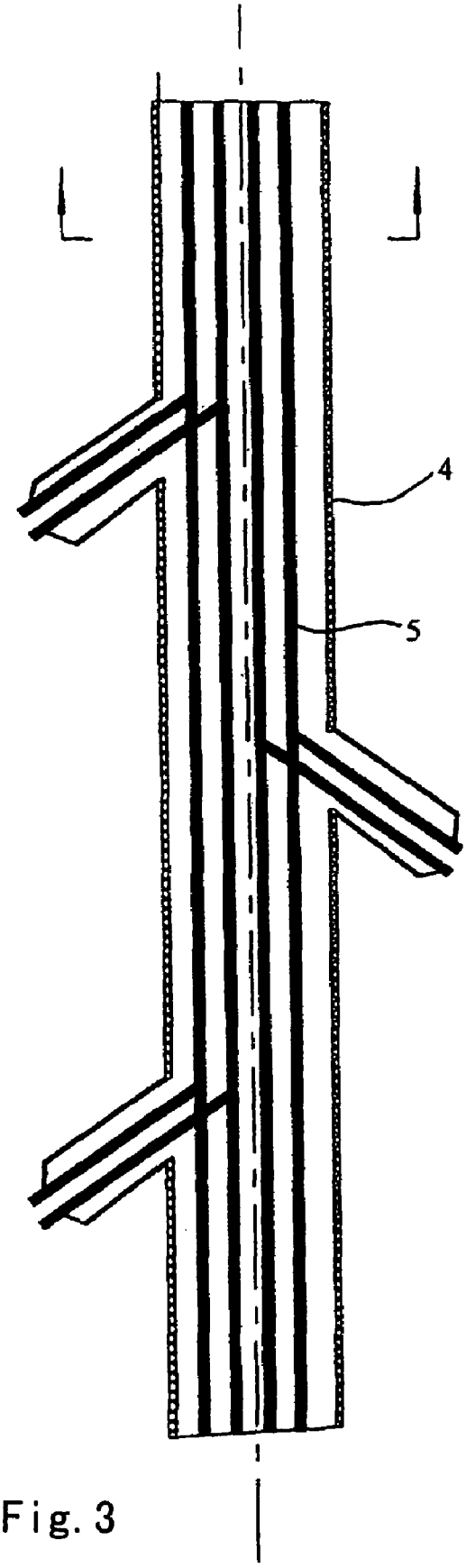
FIG. 3 is a structural drawing of cable wires distributed through the plastic soft tubes.
Figure 4:
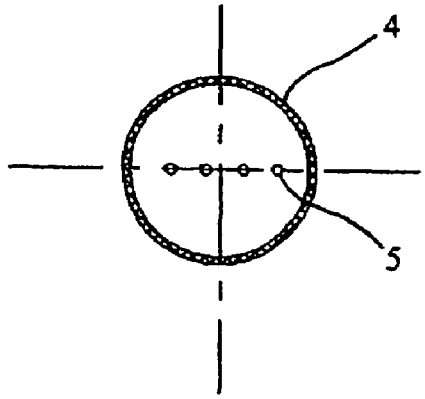
FIG. 4 shows a cross-section of FIG. 3.

The multiple resulting twigs are inserted into the top of the tree stem through linkers, refer to FIG. 2. Power supply block terminal 12 is sealed and mounted on the top of stem 1, and introduces cable linker 14 by water proof lock 13, which is configured for water proof and to prevent the twigs from pulling off. The lower edges of the stem top are distributed with many pin square steel tubes 11 or the round tubes with positioning devices for fixing twig 2. Cable linker 14 led out from stem 1 and cable linker 14' on twig 2 are brought into contact and locked, which makes the power supply control in stem 1 to supply electrical current to the illuminant bodies of the imitation plant and the adjusting control sets the illuminant bodies to be twinkling or lighting constantly and the illuminant imitation plants are thus made.

EXAMPLE 2

Figure 7:
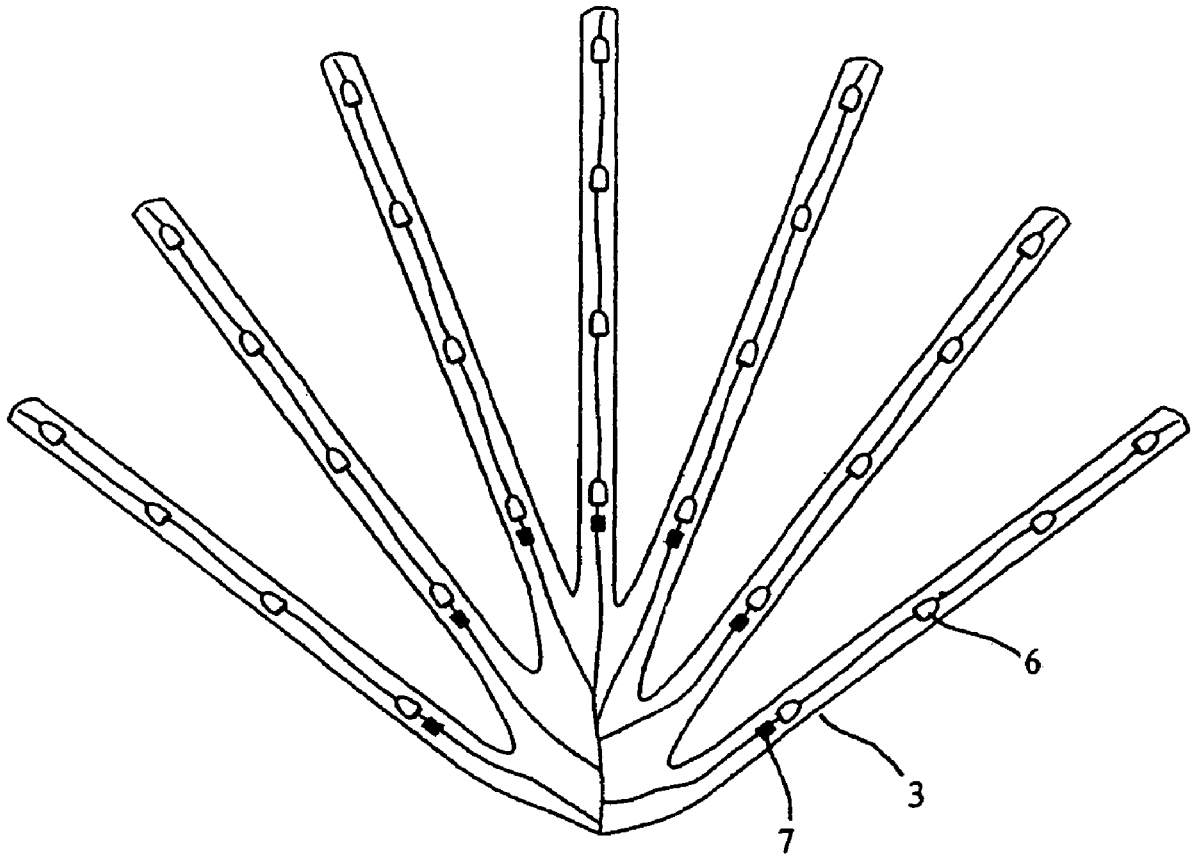
FIG. 7 shows another structure of a leaf of the present invention.
Figure 8:
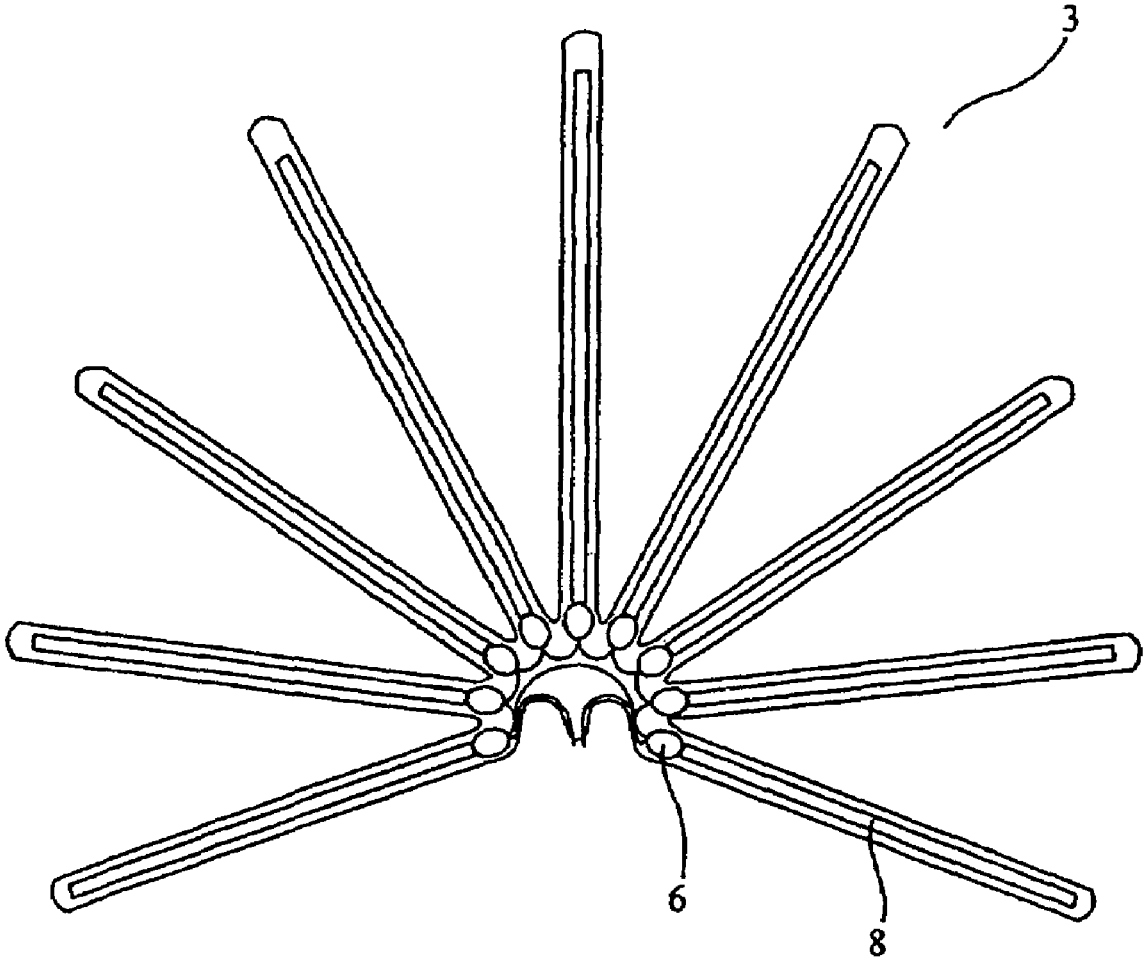
FIG. 8 shows another structure of a leaf of the present invention.

As shown in FIGS. 1, 7, 8, 9, 10, 11, 12, 13 and 14, the imitation plant of the present invention may adopt various types and shapes of trees, refer to FIG. 1. Stem 1 of the large scale plant may be made of the cement or poured by the resin and the metal framework, or poured by the plastic and the metal framework, also it can be made either a whole stem or segmented stems and then to be assembled into an entire stem on the spot. The smaller scale plant can be made of the resin or the plastic materials and the outer layer of the stem may be molded as a real tree with natural color and also be arranged with multiple stem light circles on it. These light circles are constructed by illuminant body 6 such as LED tube and the segmented photo conducting materials are connected in series at intervals to form light bands or light circles, and also can be stuck to or winded around the outer surface of the stem or poured into the photopermeable resin plastic materials and form the stem light circles arranged at intervals, refer to FIG. 9. Stem 1 interposes and fixes multiple twigs 2 through socket device, and there are many leaves 3 located on twigs 2. Both twigs and leaves are made imitating the natural plant and colors and show real soft patterns, refer to FIG. 1. In order to obtain the real and vivid effects, twigs and leaves are made with the structure of hollow cavities, refer to FIGS. 5*a*, 5*b* and 5*c*. Further, twigs 2 and leaves 3 are shaped by plastic molding, and the edges of leaves are thinner and soft, the middle is thicker located with elastic framework tendon 31 in which hollow cavities are distributed in the same direction as tendon 31 and they are for inserting elastic supporting rods and inserting light bands. According to the thickness of twig 2, the elastic supporting rod with specific thickness can be selected with the steel rod, even an elastic supporting rod which is formed by several steel strips being twisted together. The elastic supporting rods used in the leaves are generally made of steel wires with different thickness, which are inserted into a cavity of the twigs or leaves, meanwhile, illuminant body 6 such as LED tube or EL cold light laminae or wires and the segmented photo conducting cylinders made of photo conducting material are connected in series at intervals to form a continuous light band or a light strip and then pass through a hollow cavity or another cavity of the leaves. It may be sealed by glue if necessary. The leaves and twigs are connected by steel wires. It may be that one twig connects with multiple leaves or one twig connects with one leaf, all depending on the patterns of the plants, refer to FIGS. 7, 8, 11, 12 and 13. Also the electrical wires of the illuminant body are connected at the same time, wherein the leaves in FIG. 7 are connected through the electrical wires of illuminant body 6 distributed in leaves 3, with all resistors 7 connected in series at the ends. Long segmented photo conducting materials 8 are installed in leaves 3 in FIG. 8, and illuminant bodies 6 are at the section of the root so as to form light strips or light bands. Also the light bands and light strips can be fixed on the twigs or leaves by sticking, e.g., the photo conducting materials can be segmented into pieces of photo conducting cylinders and the illuminant bodies and the photo conducting cylinders get to connected in series at intervals to form continuous light bands or light strips, refer to FIG. 16, and then using transparent glue tape to stick them onto the twigs and leaves. The resulting leaves are generally single layer of big lamina made of color fabrics. Moreover, the illuminant body can be constructed as shapes of strip, laminates and leaves, to form continuous light bands or light strips or leaves, refer to FIGS. 17 and 18, even it can be an illuminant body opposite to a length of photo conducting material to form a light band or a light strip, refer to FIG. 19. The patterns of the light band are optional and various, depending on the practical requirements. The photo conducting materials may be selected from easy-photo-conducting transparent material, e.g., PVC or EVA, etc. The other method of making twigs and leaves is to make illuminant body and photo conducting material as light bands according to foresaid methods and then to press the light band together with elastic steel wires and flexible outer leaves as a whole entity by the way of plastic molding, so that leave 3 and twig 2 with sealed structures are thus produced. Finally, twig 2 with distributed leaves on it is inserted into stem 1 and the power supply control of the imitation plant connects with the wires of illuminant bodies on each twig 2, leave 3 and imitation stem 1, by which the outside power supply provides electrical current to the lamp series and an illuminant imitation plant is thus produced.

The invention claimed is:

1. An illuminant imitation plant comprising stems, twigs and leaves, wherein said stems are built up as pattern and color of a real plant; and elastic supporting rods or elastic framework tendons installed in middle of said twigs and leaves, and interposed in said stems with multiple leaves distributed on them; said leaves imitating natural leaves and colors and showing natural soft patterns, the leaves being installed with elastic strips and distributed with light bands made of illuminant bodies and photo conducting material.

2. The illuminant imitation plant of claim 1, further comprising light circles or light bands glued to, or winded by pouring around, or set into outer surface of said stems and fixed inside the stems to form light circles or light bands arranging at intervals.

3. The illuminant imitation plant of claim 1, wherein said elastic strip are elastic steel wires.

4. The illuminant imitation plant of claim 1, wherein illuminant bodies and the photo conducting materials are arranged at intervals and pass through hollow cavities of, or affixed to the leaves, twigs or stems, and the illuminant bodies are made of EL cold light laminae or OLED illuminant laminae.

5. The illuminant imitation plant of claim 4, wherein each of the leaves defines a hollow cavity with elastic framework tendons disposed inside the hollow cavity, the leaf comprising platy leaf blades on two sides of the hollow cavity; the hollow cavity being disposed in the leaf in the same direction as that of the framework tendon respectively for installing the elastic supporting rods and the light bands.

6. The illuminant imitation plant of claim 5, wherein said hollow cavity is a configuration comprising a single supporting hole and a single illuminant placing hole, or a configuration comprising double supporting holes and double illuminant body placing holes, or a configuration comprising a single supporting hole and double illuminant body placing holes.

7. The illuminant imitation plant of claim 1, wherein said illuminant bodies are made of LED tubes or EL cold light wires or EL cold light laminae, or OLED illuminant body laminae.

8. The illuminant imitation plant of claim 1, wherein top of one of said stems is airtight and connects with power supply block terminal which is connected with a cable linker through a cable water proof lock.

9. The illuminant imitation plant of claim 8, wherein cables are installed inside plastic soft tubes in said twigs, and are airtight sealed at openings of the plastic soft tubes; a space is kept inside plastic soft tubes.

10. The illuminant imitation plant of claim 1, wherein the elastic supporting rods installed in the twigs are made of a steel wire or multiple steels wires.

* * * * *